United States Patent [19]

Goedde et al.

[11] 4,273,617

[45] Jun. 16, 1981

[54] METHOD AND APPARATUS FOR QUENCHING HEATED BULK MATERIAL

[75] Inventors: Franz Goedde, Stolberg; Wolfgang Schrank, Alsdorf; Fritz Schulte, Meerbusch, all of Fed. Rep. of Germany

[73] Assignee: Hartung, Kuhn & Co. Maschinenfabrik GmbH, Duesseldorf, Fed. Rep. of Germany

[21] Appl. No.: 169,039

[22] Filed: Jul. 15, 1980

[30] Foreign Application Priority Data

Jul. 20, 1979 [DE] Fed. Rep. of Germany ..... 2929390

[51] Int. Cl.[3] ..... C10B 39/04; C10B 39/14

[52] U.S. Cl. ..... 201/39; 202/227

[58] Field of Search ..... 201/39; 202/227

[56] References Cited

U.S. PATENT DOCUMENTS

| | | | |
|---|---|---|---|
| 3,806,425 | 4/1974 | Ekholm et al. | 202/227 X |
| 3,876,143 | 4/1975 | Rossow et al. | 202/227 X |
| 3,959,083 | 5/1976 | Goedde et al. | 202/227 X |

FOREIGN PATENT DOCUMENTS

| | | | |
|---|---|---|---|
| 2407689 | 8/1975 | Fed. Rep. of Germany | 202/227 |

*Primary Examiner*—Frank W. Lutter
*Assistant Examiner*—Roger F. Phillips
*Attorney, Agent, or Firm*—W. G. Fasse; D. F. Gould

[57] ABSTRACT

Heated bulk material, such as coke, is quenched by a liquid flowing from the top downwardly through the bulk material. During the quenching the bulk material is closed off from the atmosphere. The steam forming from the quenching liquid is carried off downwardly in parallel flow with the quenching liquid. For this purpose the amount of quenching liquid distributed over the bulk material is so measured or dosed that it participates completely in the quenching process, whereby the quenching liquid evaporates completely except for a specific residual moisture in the coke. The flow resistance which varies over the base surface of the bulk material is compensated by a carry-off resistance which is inversely proportional to the respective bulk material height. The varying of the flow resistance is due to a bulk material height which changes from one side of the quenching container to the opposite side as a result of an inclined container bottom. Additionally, the amount of quenching liquid distributed over the top surface of the bulk material is substantially proportional to the respective height of the bulk material. The quenching chamber is provided with an inclined, perforated bottom. The perforations are so dimensioned that the ratio of bulk material height to the respective open passage area of the bottom is approximately constant.

7 Claims, 4 Drawing Figures

METHOD AND APPARATUS FOR QUENCHING HEATED BULK MATERIAL

BACKGROUND OF THE INVENTION

The invention relates to a method and apparatus for quenching a heated bulk material, more especially coke, by means of a liquid which flows from the top downwardly through the bulk material. The quenching chamber closes off the bulk material against the outside air or atmosphere and the steam which forms from the quenching liquid is carried off downwardly in parallel flow with the quenching liquid. The quenching liquid and the steam forming therefrom flow from the top downwardly through the bulk material until the steam attains a specific temperature. For this purpose the amount of quenching liquid distributed over the bulk material is so measured that it participates fully in the quenching process and is hence completely evaporated except for a specific residual moisture in the coke.

Such a method and a corresponding device are known from German Patent No. 2,320,057, wherein the height of the bulk material is kept constant over a substantially horizontal base area or bottom and the base box is movable hydraulically for emptying the container.

The known method and the corresponding device have been used successfully in practice. However, it has to be noted that the quenching result is disadvantageously affected if irregularities in the height of the bulk material are not compensated at all or are not compensated with an adequate thoroughness. The quenching liquid distributed uniformly over the bulk material and the steam forming therefrom flow preferably through those regions of the bulk material where the height or depth of the bulk material is the least. The bulk material is thus quenched more rapidly in those regions where the flow resistance is least, than in other regions having a higher flow resistance where the quenching proceeds more slowly. Depending on the duration of supplying quenching liquid, differences in the height or depth of the bulk material lead to the result that either specific regions of the bulk material are not quenched or are not quenched adequately or other regions have, after the completion of the quenching process, too high a water content. While an inadequate quenching of bulk material, for example in the case of coke, cannot be accepted already for reasons of safety, use of too large an amount of quenching liquid leads to a surplus of liquid which has to be carried away. Excess quenching liquid requires a collecting water reservoir including a purification system as well as a pumping and pipeline means.

OBJECTS OF THE INVENTION

In view of the above it is the aim of the invention to achieve the following objects singly or in combination:

to provide a method for quenching a heated bulk material which is held in a quenching chamber so as to have differing bulk depths or heights;

to make sure that the moisture content of the quenched material is as small as possible and is moreover distributed uniformly throughout the volume of the bulk material;

to provide a quenched bulk material of uniform consistency and which is relatively dry;

to avoid all means for carrying-away, storage, and reprocessing of surplus quenching liquid;

to provide a bulk material which is as dry as possible and which is qualitatively uniformly well quenched even if the bulk material is present in the quenching chamber to differing heights;

to avoid the need for supplying the bulk material at uniform depths for the quenching operation;

to simplify the emptying or discharge operation of the quenched bulk material by using an inclined bottom in the quenching container or chamber;

to incline the quenching chamber bottom in accordance with the angle of slide of the bulk material; and to adapt the flow resistance through the bulk material and the distribution of the quenching liquid quantity over the bulk material top surface to the respective height or depth of the bulk material supported on the slanted bottom of the quenching chamber.

SUMMARY OF THE INVENTION

According to the invention there is provided a method for the quenching of heated bulk material, wherein the flow resistance, which varies over the base area of the bulk material and which results from a varying height or depth of the bulk material due to a bulk material support inclined relative to the horizontal in accordance with the angle of slide of the bulk material, is compensated by a carry-off resistance which is conversely proportional to the respective height or depth of the bulk material in such a way that the flow resistance per unit of area over all base area zones is approximately constant, and wherein the amount of quenching liquid is distributed proportionally to the respective height or depth of the bulk material over the top surface area of the bulk material.

With the method of the invention, two factors, namely the flow resistance and the amount of liquid are adapted, in any region above the base or bottom area of the fill or batch of bulk materials, to the respective height of the bulk material. Merely adapting the distribution of the amount of quenching liquid over bulk top surface area to the respective height of the bulk material would result in a non-uniform quenching of the bulk material unless the flow resistance per unit area is also made uniform by said compensation. This is so, because the steam, in any event takes the path of least resistance, whereby differing flow conditions in the bulk material result already at the start of the quenching operation. Non-uniform flow conditions in turn cause the bulk material to be quenched more rapidly in regions of lesser height of the bulk material. Such more rapid quenching causes, at the same time, in these regions a reduction in the flow resistance. As a result, the quenching water subsequently applied flows to an increased extent through these already quenched regions. However, where the bulk material is already quenched, the quenching liquid can no longer evaporate and emerges underneath the bulk material as surplus water. The invention avoids this problem by the combination of steps set forth above which make the flow resistance substantially uniform throughout the bulk material in combination with the proportional application of quenching liquid relative to the heights of the bulk material. Thus, the invention produces a relatively dry and uniformly quenched bulk material. Such features determine the quality of the bulk material, especially in the case of coke.

For carrying out the present method, use may be made of a device which comprises a fireproof container or chamber having a pervious base for receiving the hot bulk material. According to the invention the base or bottom is inclined relative to the horizontal in accordance with the angle of slide or slide angle of the bulk material. The bottom has a perforation, the free flow perforation cross-section area over the container base is dimensioned to vary in such a manner that the ratio between the respective height of the bulk material and the free flow cross-section of the perforations arranged respectively under the bulk material is approximately constant.

It is possible to achieve optimal results with the device of the invention due to the inclined filling of the bulk material, which is known as such in connection with coke quenching. It has become further possible to dose the amount of quenching liquid distributed over the bulk material in such a manner that surplus quenching liquid no longer accrues and consequently carry-off equipment for such surplus quenching liquid has been obviated. Moreover the device of the invention allows the avoiding of special emptying equipment for the quenching chamber which has been necessary heretofore for emptying a container having a horizontal base or bottom.

In accordance with a particularly advantageous embodiment of the device of the invention, the container rests on an inclined upper part of a box which forms the previous container bottom which comprises a grating frame arranged in a slanting plane and which carries grating rods and spacer washers of differing sizes between the rods to provide varying free flow passage areas between adjacent rods. The container is closable at least on one side by a swingably mounted flap or door.

The container receiving the hot bulk material is made of heat resistant material, whereby the previous base or bottom extends for example at an inclination of about 27° relative to the horizontal. The bottom perforation or rather the free flow area thereof can be adjusted so as to provide varying widths between different rods or bars by means of the spacer washers. The lid or cover closing the container tightly communicates with a pipeline which has outlet openings, directed at the interior of the container, for supplying quenching water to the top of the bulk material. Nozzles of smaller size are preferably located above bulk material zones of smaller depths whereas nozzles of larger size or liquid supply capacity are located over bulk material zones above larger bulk depths.

According to the invention a lifting mechanism is arranged for cooperation with the container or quenching chamber whereby the container is movable through a definite stroke length and with a pressure tightly closing against the lid or cover which is equipped with quenching water discharge means such as the above mentioned nozzles. Alternately the container may be moved against a dust collecting device equipped with suction means of conventional construction.

The structure of the present quenching chamber makes it possible, depending on the quantity of bulk material to be received, to provide a so-called one-point positioning during the charging. Thus, especially the arrangement of a tight transition system for example between a coke oven chamber and a coke reception container may be achieved. These features achieve by relatively simple means a reliable environmental protection by a complete suppression of emissions of dust when the coke is pushed out of a coke oven chamber. Prior to each quenching operation the container or quenching chamber may be moved against the fixedly-installed lid by means of the lifting mechanism in accordance with the invention with a definite pressure and stroke. To raise the container, instead of lowering the lid, has the advantage especially in connection with older coke oven plants in which the coke reception container has to be raised for the emptying to the ramp level thus requiring, for example, a hydraulic lifting device, that with the lifting device of the invention the container can be moved in a stroke- and pressure-limited manner against the lid and thus only one equipment is necessary for two different method steps.

BRIEF FIGURE DESCRIPTION

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
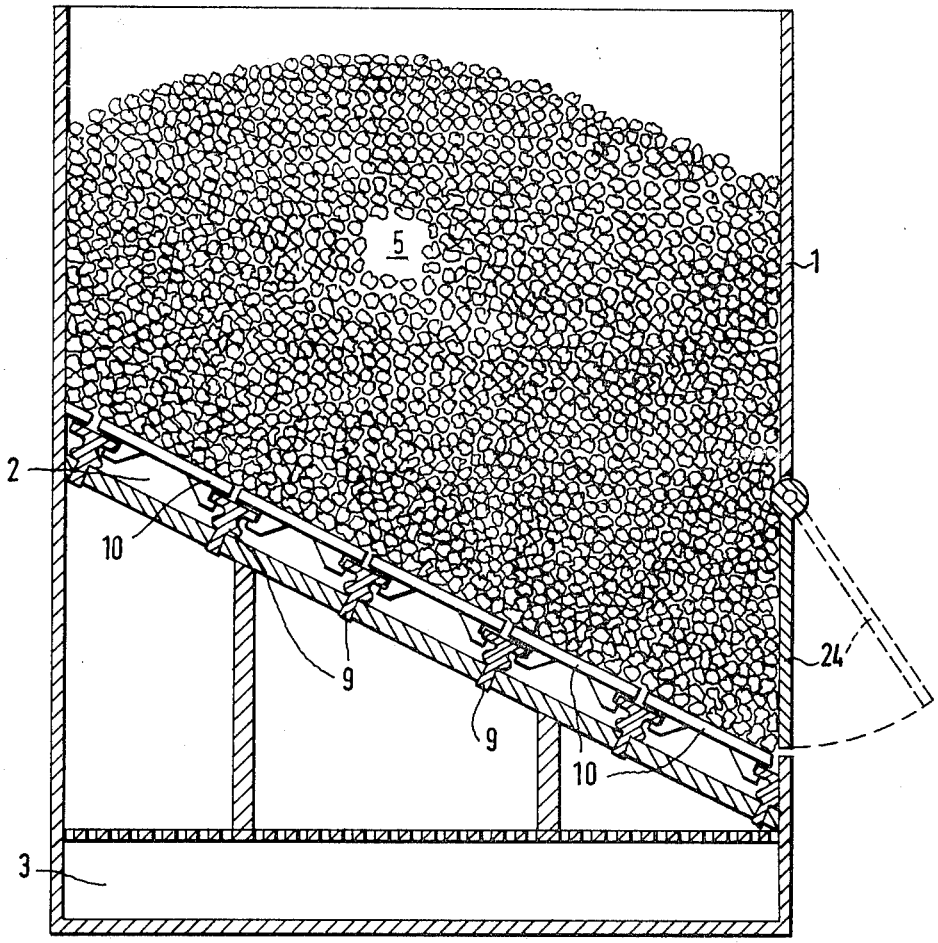
FIG. 1 shows a vertical section through a coke receptacle or quenching chamber.
Figure 2:
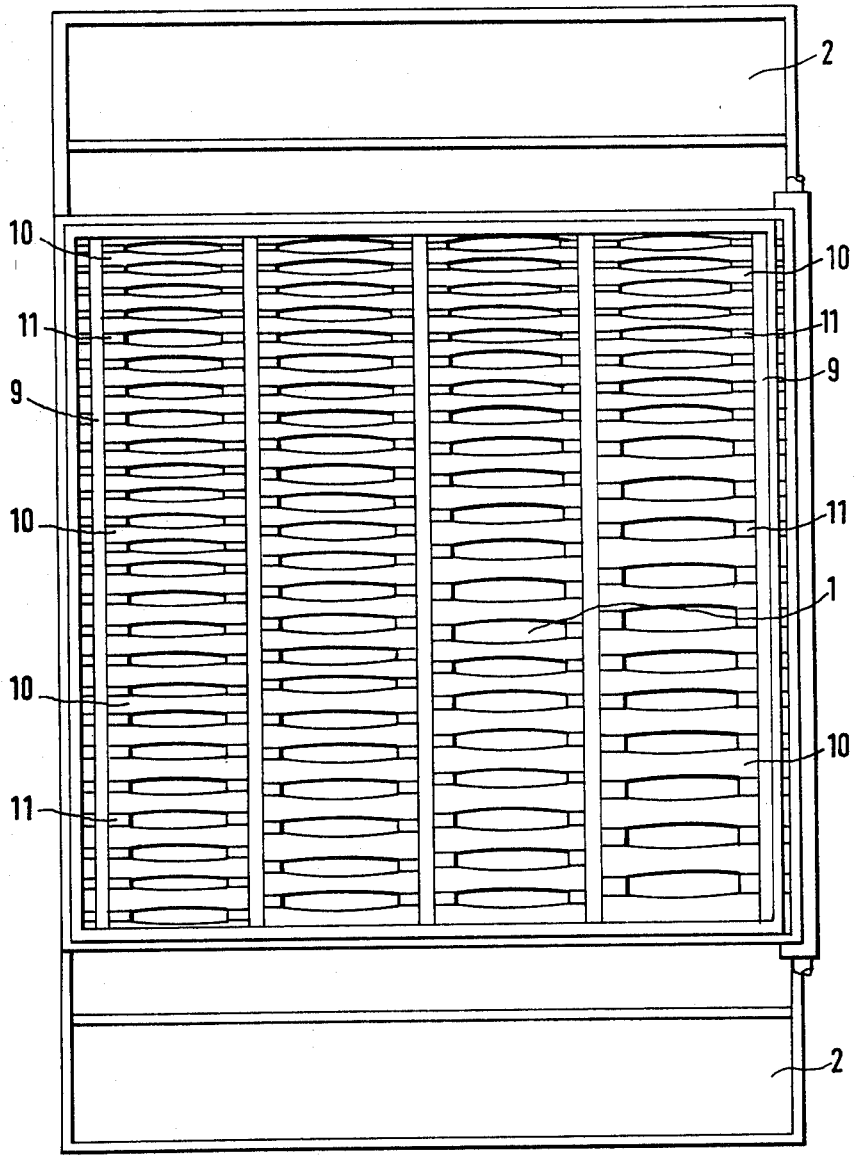
FIG. 2 shows a top plan view of the coke reception container of FIG. 1.

FIG. 1 shows an approximately cubical container or quenching chamber 1 having a previous base or bottom 2 which is inclined at about 27° to the horizontal. A firebox 3 is located under the chamber 1 and exhaust steam ducts 4 connected to two sides of the chamber ensure that the steam arising from the quenching liquid may be carried off in a channelled manner free of entrained air. A batch 5 of coke is present in the container 1. The coke has a temperature of over 1,000° C. prior to quenching.

Figure 3:
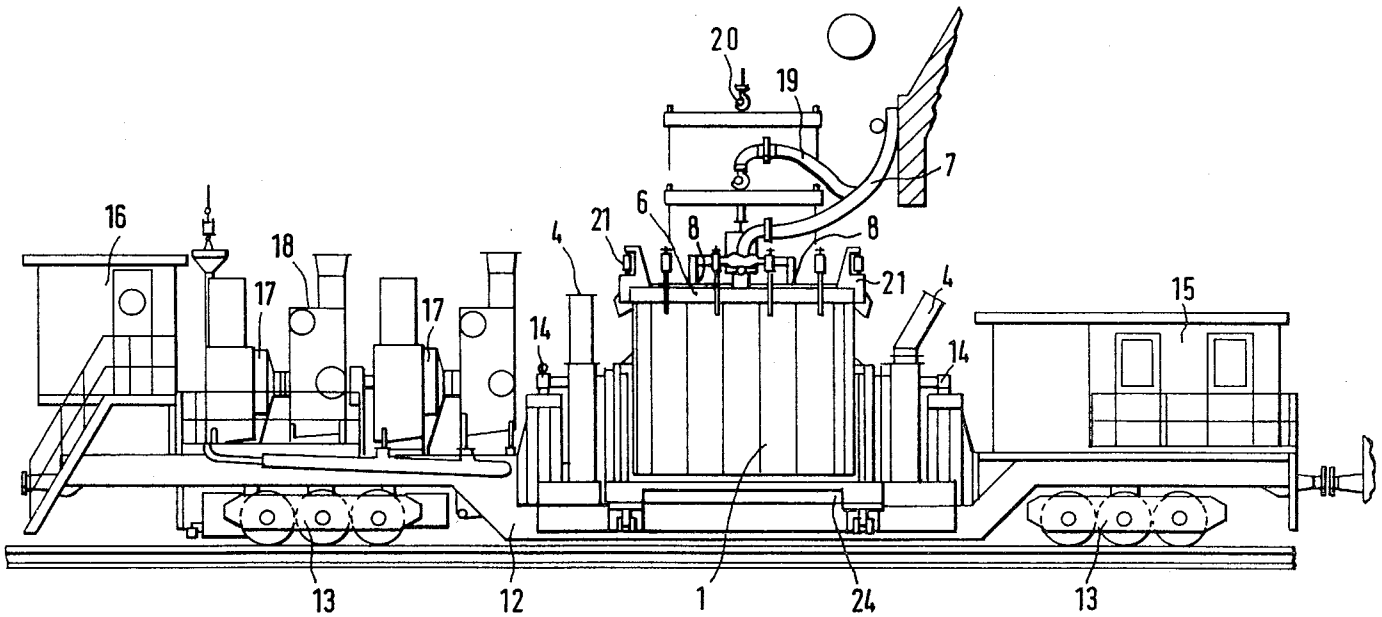
FIG. 3 shows a mobile coke reception container on a carriage and cooperating with a quenching station.

To empty the container 1, a hydraulically swingable flap 24 is provided at its side and facing toward a ramp not shown. As shown in FIG. 3, the container 1 is closed in a tight manner by a lid or cover 6. The lid 6 is connected to a pipeline 7 and has outlet openings 8 which are distributed uniformly over the surface and which are directed toward the interior of the coke reception container 1. These openings 8 may deliver different quantities of quenching water over different surface areas of the bulk material. The lid 6 is hollow whereby the quenching liquid nozzles are arranged inside the lid facing the interior of the container. As a result of this hollow construction the lid retains, after the conclusion of the quenching operation, a quantity of quenching liquid which prevents any excessive rise in the temperature of the lid.

The container bottom 2 which is inclined at about 27° comprises a grating frame 9 to which grating rods or bars 10 are secured. The spacing between adjacent rods 10 may be adjusted as a function of the height or depth of the bulk material by means of exchangeable spacers or washers 11. Thus, the perforation or free flow cross-sectional area in the container bottom 2 can be varied. For the adjustment of the perforation cross-section or free flow area in the container base 2, as a function of the height of the bulk material lying thereabove a simple mathematical-physical relation can be used.

The overall pressure loss which occurs during the quenching operation corresponds to the sum of the pressure loss from the coke batch 5 and the pressure loss at the container base 2.

$$\Delta P_{over.} = \Delta P_{fill} + \Delta P_{container\ base}$$

In order to effect a uniform quenching of the hot bulk material 5 the overall pressure loss is to be kept constant throughout the batch, thus $$\Delta P_{over.} = \text{const.}$$

Since the effect of the different or varying heights of bulk material is to be compensated in accordance with the invention, the pressure loss at the container base 2 must be locally matched or adapted to the respectively varied pressure losses in the batch 5.

The first approximation assumes that the pressure loss in the fill is linearly proportional to the height or depth of the batch 5 above the base 2.

$$\Delta P_{fill} = \text{prop.} f(\Delta h_{fill})$$

Based on that assumption and on the geometry of the coke quenching chamber 1 the following relation can be set up:

$$\begin{aligned} \Delta P_{fill} &= \text{prop.}\ f(\Delta h_{fill}) \\ &= \text{prop.}\ f(H - \Delta e - \Delta a) \\ \text{or} \quad &= \text{prop.}\ f(H - \Delta e - (\Delta b \cdot \tan \alpha)), \end{aligned}$$

wherein:

H is the container height;

e is the spacing between the fill surface and the upper edge of the container;

a is the counter-cathetus of the angle of inclination of the container base;

b is the ancathetus or adjacent cathetus of the angle of inclination of the container base; and $\alpha$ is the angle of inclination of the container base.

For the pressure loss at the container base 2, the following relation can be set up:

$$\Delta P_{Grate} = \frac{\rho \cdot w^2 \cdot \phi}{2g},$$

wherein:

$\rho$ = the coefficient of resistance as a function of the aperture ratio (free flow area to closed off area);

w = steam exit speed;

$\phi$ = density of the steam; and g = gravity.

The following elements are constant: the steam speed (w), the quotient of the volume flow (V) and the grate cross-section (A); the coefficient of resistance ($\delta$), the density of the steam per unit of time (P), and gravity (g). Therefore:

$$\Delta P_{container\ base} = f(\Delta w)^2$$

$$= f\left(\sqrt{\frac{V}{A}}\right.$$

Since the total volume flow per unit of time is also constant, the pressure loss at the container base 2 may be expressed by the relation:

$$\Delta P_{container\ base} = f(\sqrt{\Delta A})$$

Thus, the desired constant overall pressure loss ($\Delta P_{over.}$) is a function of the height of bed ($\Delta h$) and the opening or free flow cross-section at the container base ($\Delta A$)

$$\Delta P_{overall} = f(\Delta h, \Delta A)$$

With reference to a numerical example, the following may result for the planning of the varying perforation at the container base.

A coking plant produces 12 tons of coke in each coking furnance. The coke has a bulk weight of 0.45 t/m$^3$, so that the coke reception container 1 should have a useful volume of about 27 m$^3$. Accordingly, the container 1 has dimensions of 3.3 m×3.3 m×3.3 m and a pervious base 2 which is inclined at about 27°.

The different bed heights above the container base 2 are within the range of 1.2 m to 2.4 m.

Representative measurements have shown that over a coke batch of 3 m×3 m×3 m having a temperature of 1,100° C., a steam pressure of about 0.45 bar occurs with a water delivery of about 50 dm$^3$/second. As the steam formed from the quenching liquid flows through the batch, there occurs a pressure loss of 0.24 bar, i.e., the pressure loss per meter of bed height is about 0.08 bar. Additionally, it has been ascertained or measured that, under these operating conditions, the steam pressure decreases by about 0.1 bar when the steam passes through a grating having an overall aperture ratio of about 15% (free flow area to closed off area).

For the above example the overall pressure loss shall be 0.3 bar.

This means, in accordance with the following relation, that:

$$\Delta P_{over.} = \Delta P_{fill} + \Delta P_{container\ base}$$

$$\Delta P_{over.} = \text{prop.} f(H - \Delta e - (\Delta b \cdot \tan\alpha), (\Delta w)$$

$$\Delta P_{over.} = \text{prop.} f(\Delta h, \Delta A).$$

For the two extreme heights or depths of bulk material 1.2 m or 2.4 m the respective pressure loss is 0.096 bar or 0.192 bar respectively. In the case of a desired overall pressure loss of 0.3 bar, the resistance at the container base must be 0.204 bar or 0.108 bar respectively. By virtue of the quadratic relationships between the pressure loss at the container base and the aperture cross-section, the aperture ratio must be 4% or 15% respectively. Still remaining non-uniformities in the quenching effect, caused by statistically recurrent bulk height differences and dissociation processes in the grain distribution when the container is being filled, must be compensated by a fine adjustment of the free flow areas or passages over the grating surface.

All the other bed heights or bulk depths between these extreme values can be determined in a simple way by using the tangent of the angle of inclination of the container base, and the aperture ratio of the perforation at the container base can be designed accordingly. The practical implementation of the ascertained aperture ratio in the arrangement of the grating bars 10 at the container base 2 may, as has been stated above, be accomplished in that spacers or washers 11 are placed between the individual bars 10 and thus the necessary gap widths between the bars 10 can be set or adjusted.

As shown in FIG. 3, the coke reception container 1 is arranged on a mobile low-loader or carriage 12. Under the coke reception container 1 there are disposed a free box 3 and connected thereto the two exhaust steam ducts or channels 4 for carrying off the steam formed from the quenching liquid. To move the coke container 1, the low-loader 12 is mounted on drive bogies 13. To lift the container 1, hydraulic cylinders act on its two sides. Electrical and hydraulic control means are located in a control center 15. The individual operations are initiated and monitored by an operator in a driver's cab 16.

Furthermore, exhaust and dust removal units 17 or 18 respectively are arranged on the low-loader 12 for removing the emissions of coke dust which are released when the coke is pushed out of the coking furnace. The water supply to the quenching lid 6 seated tightly on the coke reception container 1, is effected by means of a flexible pipeline 19.

For quenching the heated bulk material 5, either the lid 6 can be lowered with a lifting means 20 or the container 1 can be moved against the fixedly installed lid 6. When the lid 6 is lowered hydraulically actuated clamping means 21 become effective for sealing the container 1 with the lid 6. However, if the container 1 is moved against the fixedly-installed lid 6, a force limitation is provided in the mechanical or hydraulic actuating means not shown since they are conventional.

Figure 4:
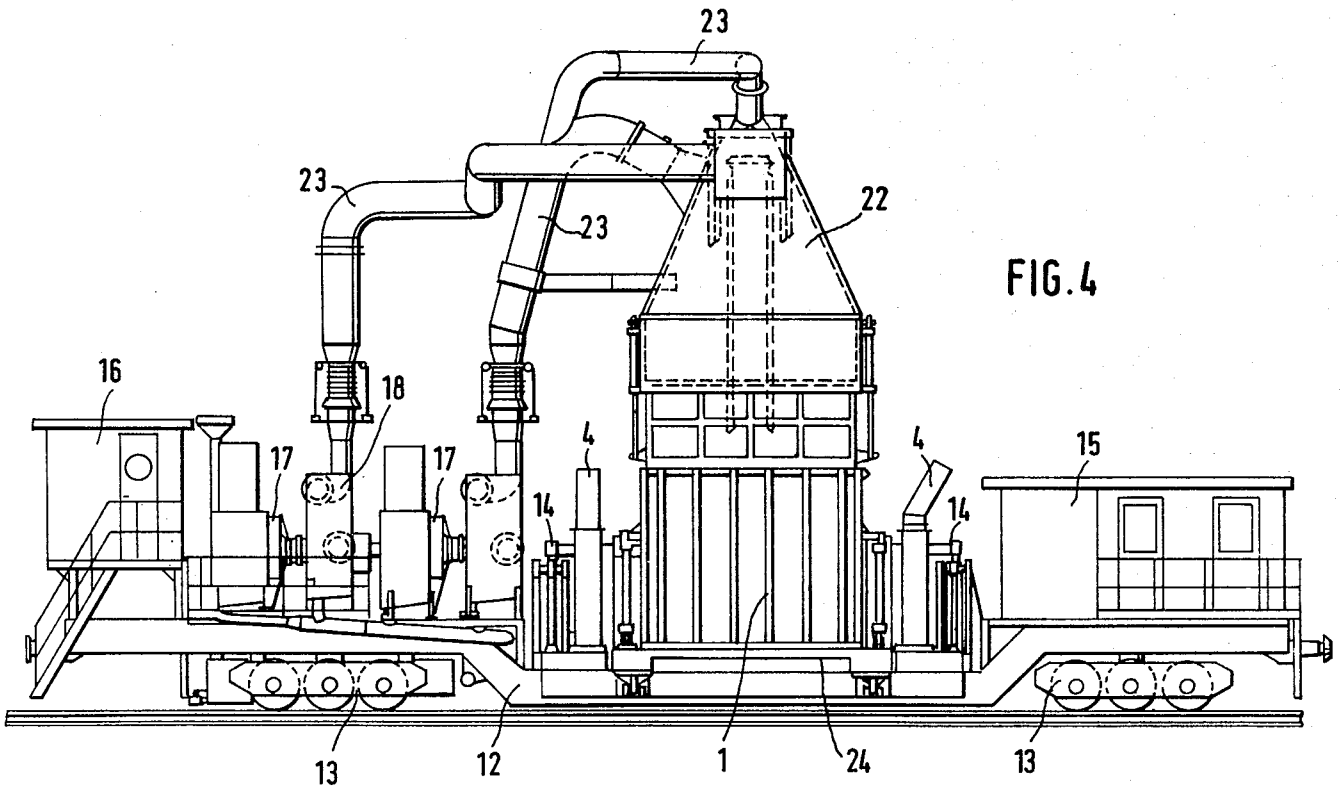
FIG. 4 shows a coke reception container of FIG. 3 at a charging station.

As shown by FIG. 4, the container 1 has such dimensions that its top opening cross-section can be connected in a fitting member to a tight dust catching device 22 during the coke forcing out operation to collect the emissions of coke dust.

The approximately cubical dimension of the coke reception container 1 ensures that it can be filled in a one-point position, in other words, the filling does not require moving the container more than once. The emissions of coke dust to be removed are exhausted through a pipeline system 23.

The method of the invention is carried out as follows with the mechanism shown in FIGS. 3 and 4.

After the coke container 1 butts in a sealing manner against the dust collector device 22, which is mounted to a coke-cake guide wagon or carriage, the coke is pushed into the container 1. During the pushing out of the coke, the emissions of coke dust are exhausted through the pipeline system 23 by the suction device 17 and are cleaned in the dust removal device 18. When this operation is completed, the low-loader 12 is moved to the quenching lid 6, which is accordingly or after that lowered onto the coke container 1. The closure clamps 21 ensure a proper seal between the lid 6 and the container 1.

As soon as the water supply is switched on, steam develops in the upper layers of the hot bulk material 5 in accordance with the Leidenfrost phenomenon.

Due to the pressure under the lid the steam is forced to take its path downwardly through the batch 5, whereby an approximate equilibrium is established between the heat reduction caused by the water evaporation in the upper layers of the batch 5 and the heat output in the depth of the batch 5. The equilibrium is supported by the superheating of the steam and the continuing evaporation of the residual Leidenfrost drops.

As a result of the water delivery which is adjusted to the respective varying bulk depths and to the correspondingly adjusted perforations in the base 2, the zones of the water evaporation are distributed decreasingly and the zones of steam superheating are distributed increasingly from top to bottom over the height of the batch 5, so that the same amount of heat is removed from the batch at each point at the same time.

A desired residual water or moisture content in the coke can be achieved in that the gradient of the exhaust-steam temperature is used to terminate the quenching operation. As the result of a controlled termination of the quenching operation at a steam temperature of 400° C., a lower residual water content is achievable in the coke than is the case of a switch-off temperature of, for example, 200° C.

Absolute, residual water contents in the coke of an average up to 1% may be achieved with the method of the invention.

Following on the quenching operation, the low-loader 12 is driven to the coke dumping ramp, where the quenching container 1 is emptied. For this purpose the flap 24 is opened. The inclined container base 2 is particularly advantageous in the emptying operation because the container 1 can be emptied without being tilted and without additional emptying mechanisms being necessary. In the case of modern coking plants, the upper edge of the coke dumping ramp will be placed at the same level as the quenching wagon track, so that the container 1 does not have to be raised for emptying.

Although the invention has been described with reference to specific example embodiments, it will be appreciated that it is intended to cover all modifications and equivalents within the scope of the appended claims.

What is claimed is:

1. A method for quenching heated bulk material, especially coke, in a quenching chamber closed off from the atmosphere during the quenching, comprising the following steps: flowing a predetermined quantity of quenching liquid from the top downwardly through the bulk material so that the resulting steam also flows downwardly in parallel to the quenching liquid flow until the steam attains a certain temperature, said quantity of quenching liquid being such that it evaporates substantially completely except for a certain residual moisture in the coke, providing a carry-off resistance for the quenching steam which is inversely proportional to the respective bulk height above a bulk retaining, perforated grating, compensating the flow resistance of the quenching medium through the bulk material in such a manner that the flow resistance per unit area is substantially constant over the entire surface area of said grating, and distributing said quenching liquid quantity over the surface area of the bulk material such that the distributed quenching liquid is proportional to the bulk material height above said grating.

2. The apparatus of claim 1, wherein said cover means comprises quenching liquid supply means.

3. The apparatus of claim 2, wherein said quenching liquid supply means deliver less liquid to the top surface of the bulk material where the bulk material depth is small and more quenching liquid where the bulk material depth is larger.

4. An apparatus for quenching heated bulk material, especially coke, comprising fireproof quenching chamber means, cover means for closing off the quenching chamber means from the atmosphere, means for flowing a quenching liquid onto the top surface of the bulk material in the quenching chamber means so that the quenching liquid and resulting steam flow downwardly through the bulk material in a parallel flow, said fireproof quenching chamber means comprising inclined, perforated bottom means having an inclination relative to the horizontal corresponding to the slide angle of the bulk material resting on said bottom means, said bottom means further comprising perforations having a free flow cross-sectional area, said bulk material having a height above said bottom means which varies over the surface area of said bottom means, said free flow cross-sectional area of said bottom means also varying over the surface area in such a manner that the ratio between the bulk material height or depth above said bottom means and the corresponding free flow cross-sectional area is substantially constant.

5. The apparatus of claim 4, further comprising box means having an inclined top forming said perforated bottom means of said quenching chamber means, said inclined box top comprising grating frame means, a plurality of grating bars operatively supported on said grating frame means, and spacer means operatively arranged to keep said grating bars at varying spacings from one another, said quenching chamber means further comprising tiltable door means operatively secured to a side of said quenching chamber adjacent to the lower end of said bottom means.

6. The apparatus of claim 4, wherein said quenching chamber means comprise a top opening adapted for operative cooperation with said cover means or with a dust collecting system.

7. The apparatus of claim 4, further comprising carriage means for supporting said quenching chamber means to alternately bring the quenching chamber means into cooperation with said cover means or with a dust collector system.

* * * * *